US007946972B2

(12) United States Patent
Guissin et al.

(10) Patent No.: US 7,946,972 B2
(45) Date of Patent: May 24, 2011

(54) ADJUSTABLE CHAIR FOR ACCOMMODATING MULTIPLE BODY POSITIONS AND METHODS OF USE THEREOF

(75) Inventors: Rami Guissin, Beit Yanai (IL); Yonatan Arnon, Havatzelet Hasharon (IL)

(73) Assignee: Gayo Labs Ltd., Havazelet Hasharon (IL)

( * ) Notice: Subject to any disclaimer, the term of this patent is extended or adjusted under 35 U.S.C. 154(b) by 0 days.

(21) Appl. No.: 12/310,625

(22) PCT Filed: Aug. 28, 2007

(86) PCT No.: PCT/IL2007/001067

§ 371 (c)(1),
(2), (4) Date: Jun. 25, 2009

(87) PCT Pub. No.: WO2008/026209

PCT Pub. Date: Mar. 6, 2008

(65) Prior Publication Data

US 2010/0190623 A1 Jul. 29, 2010

Related U.S. Application Data

(60) Provisional application No. 60/840,425, filed on Aug. 28, 2006, provisional application No. 60/878,045, filed on Jan. 3, 2007.

(51) Int. Cl.
*A63B 26/00* (2006.01)
*A47C 3/00* (2006.01)

(52) U.S. Cl. ..... 482/142; 297/284.11

(58) Field of Classification Search ..... 482/23, 482/27–29, 54, 142, 148; 297/311, 284.11, 297/423.13
See application file for complete search history.

(56) References Cited

U.S. PATENT DOCUMENTS

| | | | | |
|---|---|---|---|---|
| 371,373 | A | 10/1887 | Scarritt | |
| 1,423,954 | A * | 7/1922 | Maussner | 5/722 |
| 1,964,216 | A | 6/1934 | Sargent | |
| 3,669,493 | A | 6/1972 | Vowles | |
| 3,902,759 | A * | 9/1975 | Monteforte et al. | 297/452.16 |
| 4,249,774 | A * | 2/1981 | Andreasson | 297/311 |
| 4,473,254 | A * | 9/1984 | Secon | 297/111 |
| 4,518,203 | A * | 5/1985 | White | 297/452.16 |
| 4,589,699 | A | 5/1986 | Dungan | |
| 4,650,249 | A | 3/1987 | Serber | |
| 4,678,229 | A | 7/1987 | Ryan et al. | |
| 4,765,684 | A | 8/1988 | Kvalheim et al. | |
| 4,765,685 | A | 8/1988 | Sudoh et al. | |
| 4,793,655 | A | 12/1988 | Kvalheim | |

(Continued)

FOREIGN PATENT DOCUMENTS

DE 41 05 512 A1 8/1992

(Continued)

*Primary Examiner* — Fenn C Mathew
(74) *Attorney, Agent, or Firm* — The Nath Law Group; William L. Klima; Jiaxiao Zhang

(57) ABSTRACT

A seating is provided that is adapted for imparting at least partial body support to a user in multiple positions. The seating apparatus has a support structure holding a body supporting assembly that includes one member defining a seating surface and another member that can be configured to form an auxiliary body support surface essentially parallel to and at a different level than the seating surface. The different level preferably includes at least one level that is below that of the seating surface.

3 Claims, 14 Drawing Sheets

U.S. PATENT DOCUMENTS

| | | | | |
|---|---|---|---|---|
| 4,832,407 | A | 5/1989 | Serber | |
| 4,905,330 | A * | 3/1990 | Jacobs | 5/705 |
| 4,960,305 | A | 10/1990 | Opsvik | |
| 5,060,327 | A | 10/1991 | Celestina et al. | |
| 5,330,254 | A | 7/1994 | Larson | |
| 5,542,746 | A | 8/1996 | Bujaryn | |
| 5,782,534 | A | 7/1998 | Desanta | |
| 5,857,739 | A | 1/1999 | Smith | |
| 6,022,071 | A | 2/2000 | Smith | |
| 6,578,915 | B2 | 6/2003 | Jonas et al. | |
| 2003/0207738 | A1 * | 11/2003 | Wong | 482/74 |
| 2005/0017556 | A1 * | 1/2005 | Terrand et al. | 297/284.11 |
| 2005/0179291 | A1 | 8/2005 | Brodeur | |

FOREIGN PATENT DOCUMENTS

| | | | |
|---|---|---|---|
| DE | 103 48 918 | A1 | 5/2005 |
| WO | WO 85/00275 | A1 | 1/1985 |
| WO | WO 88/04903 | A1 | 7/1988 |
| WO | WO 90/06704 | A1 | 6/1990 |

* cited by examiner

ADJUSTABLE CHAIR FOR ACCOMMODATING MULTIPLE BODY POSITIONS AND METHODS OF USE THEREOF

This is a National Phase Application filed under 35 U.S.C. 371 as a national stage of PCT/IL2007/001067, with the filing date of Aug. 28, 2007, an application claiming the benefit under 35 USC 119(e) U.S. Provisional Patent Application No. 60/840,425, filed on Aug. 28, 2006, and is also an application claiming the benefit under 35 USC 119(e) U.S. Provisional Patent Application No. 60/878,045, filed on Jan. 3, 2007, the entire content of which is hereby incorporated by reference in its entirety.

FIELD OF THE INVENTION

This invention relates to seats in general and more specifically to adjustable chairs.

BACKGROUND OF THE INVENTION

People spend a considerable amount of time in a sitting position, such as, sitting at work and at home, and during travel. Typically, the chairs in which the person sits are not ergonomically optimized for the person.

Several patents relating to chairs and seats include:

U.S. Pat. No. 4,765,685, to Kvalheim et al., which discloses a multi-purpose chair with a retractable knee rest. The chair of '685 comprises a typical office chair with attachments and adjustments to provide a knee rest normally positioned beneath the seat cushion.

U.S. Pat. No. 4,650,249 to Serber, discloses an ergonomic seating assembly system with front chest support, pelvic tilt seat component and various attachments to the assembly.

U.S. Pat. No. 4,678,229 to Ryan, discloses a chair, infinitely or incrementally adjustable between an upright seating mode and a full-recline mode, includes a concave seating portion continuous with a convex doubly-extensible leg support portion which combine to form an ergonomically preferred seating attitude when the chair is in a full recline mode.

U.S. Pat. No. 5,857,739 and U.S. Pat. No. 6,022,071 to Smith, disclose a swivel type chair, that functions as both a high back desk chair and a recliner. The seat and backrest pivot as a unit between upright and reclined positions and a footrest is movable pivotally with respect to the seat and is tucked underneath the seat when the chair is in the upright position to function as a desk chair and elevates to an extended position automatically when the chair is moved to the reclined position.

U.S. Pat. No. 6,578,915, to Jonas et al., discloses and adjustable chair and method of use.

US published Patent Application 2005/0179291 to Brodeur, discloses an adjustable cross-legged Yoga position support chair. The chair may include a seat for supporting a user and two adjustable leg supports for supporting the user's left and right thighs at a desired angle when the user sits in a cross-legged position. The seat may also have an attached back support. In another embodiment the chair includes a seat having a surface area wide enough to allow a user to sit on the seat in a cross-legged position and having a tapered front to allow a user's legs to hang comfortably over the front of seat while the user sits in a conventional manner; and a base operatively connected to the seat for supporting the seat, the base for allowing use of the seating chair in a conventional chair-height environment

SUMMARY OF THE INVENTION

This invention is directed to chairs, seating apparatus and seating systems for providing at least partial body support to a user in multiple positions. The invention also provides the novel seating apparatus in combination with instructions for use thereof in one or more exercises, particularly for Yoga exercises.

The novel seating apparatus of the invention is adapted to provide at least partial body support to a user in multiple positions. The seating apparatus in accordance with a general teaching of the invention has a support structure holding a body supporting assembly, said assembly comprising one member defining a seating surface and another member that can be configured to form an auxiliary body support surface essentially parallel to and at a different level than the seating surface. Said different level preferably includes at least one level that is below that of the seating surface.

The apparatus, according to an embodiment of the invention comprises a seat in a substantially horizontal orientation with a front and rear end; and at least one adjustable lower support element having or being able to assume a general horizontal orientation and being configured and operative to be selectively movable between a plurality of positions in front of the seat vertically displaced from one another, wherein in each of the positions the lower support element can assume a general horizontal orientation.

The seating apparatus may be adjusted to a variety of positions and orientation to allow, according to a preferred embodiment of the invention, a user to perform various exercises, for example, while working in an office environment. The exercises are, in some cases, relaxation or stretching exercises, such as yoga exercises.

The lower support has the form of flap or panel, typically cushioned, that can be displaced and fixed at different elevations and forward extensions in front of the seat. Typically, although not exclusively, the plurality of positions at different elevations are essentially along a vertical axis in front of the seat.

In accordance with some embodiments of the invention, the at least one lower support element has a first position in which it forms part of the seat. In accordance with this embodiment, the seat in its standard seating state is composed of two sections, the front one of which is displaceable defining the lower support element. In accordance with another embodiment of the invention, the lower support element is an independent element and in its first position it is stored under the seat, e.g. fitted in this position into a receptacle in the form of a compartment or recess, adapted therefore.

In accordance with one embodiment of the invention the seating apparatus further comprises a lower locking mechanism for locking the position of the at least one lower support element in each of the plurality of positions. Depending on the nature of the locking mechanism, the lower support element may be locked either indiscrete, pre-fixed positions, e.g. a latch-type engagement arrangement with pre-fixed locking positions, or may be an arrangement, e.g. friction-based, which permits to lock the lower support element in any desired elevational position.

In accordance with an embodiment of the invention the displacement of the lower support element is achieved by moving the lower support element, directly, to the desired position. In accordance with another embodiment of the invention, the seating apparatus comprises a mechanical mechanism ("lower mechanical means") adapted for selectively moving the at least lower support elements between the first position and each of the plurality of positions. Such a lower mechanical means may be in the form of a lever, may be a revolving crank and respective crank shaft, may be an electrical mechanism actuated by control switches, may be a pneumatic mechanism, etc.

In accordance with an embodiment of the invention, the lower support element is configured to be rotated, at least partially, about a horizontal axis to assume a plurality of angular orientations with respect to the seat. Such an axis of rotation may be in the front, middle or rear end of the lower support element. In accordance with an embodiment of the invention, the seating apparatus is provided with an angular lower locking mechanism for locking the orientation of the at least one lower support element in different angular orientations ("lower angular mechanical means"). Orienting the lower support element may be achieved by direct manipulation of the lower support element, or, alternatively, a mechanism may be provided for selectively orienting the at least one lower support elements to different angular orientations. Similarly as above, such a mechanism may be mechanical, e.g. through a series of levers and/or cables, may be pneumatic, may be electric, etc.

In accordance with some embodiments of the invention the at least one lower support element comprises two or more lower support segments, which can be moved one with respect to the other. For example, the lower support element may comprise a flap or panel, stored within a compartment in the element and extendible between a retracted position, in which it is received in a receptacle within the element, and an extended position. In the extended position, the lower support element has a larger effective area. Alternatively, the lower support element may utilize lower supporting slides, on which it may be slid and extended forward while maintaining its physical width.

Typically, the seating apparatus according to the invention comprises also at least one back support element. This element is also, according to an embodiment of the invention, configured and operative to be selectively movable between a plurality of different positions or orientations.

In accordance with one embodiment of the invention the back support element is configured to assume different positions along an essentially horizontal axis. The seating apparatus is typically provided with an appropriate locking mechanism ("upper locking mechanism") for locking the position or orientation of the at least one back support element. Similarly as in the case of the lower support element, the back support element may be manipulated into a desired position orientation by direct manipulation on the element, or an appropriate mechanical arrangement ("upper mechanical means") may be provided for selectively moving the at least one back support element to each of the plurality of positions or orientations. The upper mechanism means may be actuated through a series of levers, cranks or cables, may be electrically actuated, may be pneumatic mechanisms, etc.

In accordance with some embodiments of the invention, the at least one back support element is configured to be rotated at least partially about a horizontal axis to assume a plurality of angular orientations with respect to the seat. The axis of rotation may be at the front end, at the rear end or a mid portion of the back support element. The seating apparatus according to this embodiment typically also comprises a locking mechanism ("angular back locking mechanism") for locking the position of the at least one back support element in different angular orientations. The angular back locking mechanism may be designed for locking the orientation in fixed, discreet orientations, e.g. a latch-type mechanism, or may be configured to lock the orientation in any desired orientation, e.g. a lock mechanism which is friction based.

In accordance with some embodiments, the back support element comprises two or more upper support portions, which are typically independently or semi-independently movable one versus the other. In this manner, the back support element may assume a variety of geometries for different types of back supports. For example, at times each element may have an independent rotation-ability so that they can assume different angular orientations with respect to the seat, they can be independently moved vertically or horizontally, they can be positioned and rotated one with respect to the other in a coordinated manner by a retracting back support bar.

In accordance with an embodiment of the invention, the seating apparatus also comprises at least one, typically two adjustable armrests. According to one embodiment, the adjustable armrest is rotatable about a horizontal axis between a regular position in which it serves as an armrest and another position in which, for example, it is displaced such so as to provide more space for use of the seating apparatus for the purpose of exercising. Such displacement may, for example, be about a horizontal axis in the plane of or proximal to the seat. In its displaced position, the armrest, e.g. rotated about 180° about the horizontal axis, may serve as a hand or arm support for certain exercises. Such displacement may also, for example, be about and perpendicular to the plane of the seat, and whereby the armrest is connected to the chair along the sides of the lower support element. In its displaced position, the armrest, e.g. rotated about the vertical axis in various angles ranging typically between 90° to 270°, such that when the lower support element is lowered and extended to a particular position then the armrests may serve to support the thighs and shins in various sitting poses and certain exercises. The adjustable armrest element may also be displaced from its upper armrest position to a lower position along an axis perpendicular to the seat, for example along a vertical railing continuously or in discreet steps.

The mechanism for changing position or orientation of the different elements, and at least the position orientation of the lower support element, may, according to an embodiment of the invention, include some remotely operated motors that are associated with the different elements for changing their position or orientation. Such a motor may be a pneumatic motor, a hydraulic motor, or an electric motor, energized by the appropriate source of energy. 'The seating apparatus may, according to an embodiment of the invention, comprise a control' arrangement, e.g. a switching mechanism for controlling the position orientation of the different elements. The control mechanism may, according to an embodiment of the invention, be automatic. An automatic mechanism may comprise, for example a variety of different states, each one with its characteristic position and orientation of the different elements and by inputting a certain state the respective elements move or orient into the appropriate position.

In accordance with an embodiment of the invention, the apparatus comprises a seat portion with front and rear segments; the front segment having a first, regular seating position in which a top face thereof is level with a top face of the rear segment so that the top faces of both segments jointly define an essentially horizontal seating surface; and having a second position in which the seat is configured to have a first, essentially horizontal seating surface defined by said rear segment and a second surface essentially parallel to and at a level lower than said first surface defined by said first segment. In accordance with one embodiment said front segment is switched between the two positions in a pivotal manner, typically about a pivot at a front end of the seat. In its first position the front segment may rest on a base with a bottom face of the front segment being in contact and facing a top face of the base. Upon a pivoting switch to said second position the initially bottom face of the front segment becomes the top face defining jointly with the top face of the base said second surface.

In accordance with the teaching herein there is also provided a seating apparatus having a support structure and having at least three adjustable panels held on said support structure, comprising a lumbar support panel, a seating panel and a shin support panel; each of said panels being adjustable to assume different angular orientations about a horizontal axis, the axes of all panels being essentially parallel to one another; said apparatus having at least one first seating configuration for seating an individual in a partially kneeling posture in which said seat support panel is oriented for sitting bones and buttocks support (to support the buttocks of a seating individual), said lumbar support panel is oriented for lower back support (to support the lower back region of a seating individual) and said shin support panel is oriented for shin support (to support the shin of a seating individual); and having at least one other configuration in which the panels have different relative orientations. In accordance with some embodiments said at least one other configuration is adapted to support a seating individual in at least one other seating posture. In accordance with another embodiment said at least one other configuration that is adapted for utilizing said apparatus as an exercise apparatus. In accordance with an embodiment said shin support panel and said buttocks support panel may be oriented such that they jointly define one, essentially planar and typically essentially horizontal surface. In accordance with a further embodiment of the invention said lumbar support panel is hingedly attached to the buttocks support's rear side. Typically, the support structure of the apparatus holds one assembly of panels that comprises the buttocks support panel connected to said panel (in a manner permitting to adjust the angular orientation) and the lumbar support panel hinged thereto; and holds said shin support panel. The support panels are preferably cushioned.

In accordance with one preferred embodiment of the invention, the seating apparatus, in addition to serving as a standard seat, may also be used as a personal exercising platform. In accordance with one preferred embodiment, the seating apparatus is configured as a platform for supporting the user's body in a variety of positions, particularly yoga positions. Such yoga positions may be selected from swastikasana/sukasana, Siddhasana, badhakonasana, supta-sukasana, supta-badhakonasana, Virasana, Vajrasana, supta-virasana, adhomuka sukasana, adhomuka vajrasana, adhomuka badhakonasana, seated pavanmuktasana, adhomuka virasana, viparita, dandasana, setubandha, sarvangasana, chair sarvangasana, viparita-karani, ustrasana, uhrdva dhanurasana, shavasana and other variations.

The present invention also provides a system that permits to perform one or more exercises, for example, within an office environment, e.g. during rest periods. Such a system comprises a seating apparatus as described above; and at least one set of instructions for performing exercises using the seating apparatus, by adjusting the position orientation of at least one element of the seating apparatus. The at least one set of instructions may be in the form of printed instructions, may be in an electronic form such as computer on screen instructions, may be audio instructions, video instructions or a combination thereof, and may comprise sequences of positions, timings within each position, and breathing instructions in each position.

In accordance with one embodiment, the seating apparatus may be linked to a computer, e.g. in a wired or wireless mode, and while selecting a specific exercise or set of exercises through the computer, the seat is automatically configured (through an automatic control mechanism) into the desired state with its associated position orientation of the different elements. As part of the system there may be provided a data carrier, e.g. in the form of a magnetic or optical disc, that includes computer-readable instructions for displaying exercise instructions or optionally for issuing a control signal directly to the seating apparatus. In accordance with another embodiment, the system may comprise a dedicated site operable or a computer network, e.g. through the internet, and the instructions for carrying out an exercise may be delivered by accessing such a site.

A specific embodiment is the use of a system for yoga exercise, e.g. the type of yoga positions mentioned above, whereby the sequence of positions and durations to be spent in each position, are modified to suit the ability of the practitioner, the time of day, the user defined purpose of the exercise or position, etc.

Provided by the invention is also a method for performing an exercise comprising receiving at least one, and preferably a set of instructions for performing one or more exercises on the seating apparatus described above and then performing the exercise according to the instructions on the seating apparatus. Typically, the method comprises receiving the instructions, adjusting the seating apparatus according thereto and then performing the exercise.

BRIEF DESCRIPTION OF THE DRAWINGS

In order to understand the invention and to see how it may be carried out in practice, preferred embodiments will now be described, by way of non-limiting examples only, with references to the accompanying drawings, in which:

FIG. 6*b* is an illustration of an adjustable head support element of an apparatus of FIG. 6*a* according to an embodiment of the present invention;

DETAILED DESCRIPTION OF EXEMPLARY EMBODIMENTS

This invention describes a seating apparatus and methods for performing body exercises on the apparatus. The exercises are, for example, yoga exercises. In some embodiments the seating apparatus is an office chair for use in an office environment. Yoga poses are known to have energizing, restorative, relaxing and alertness qualities, thereby improving the productivity and well being of the practitioner.

The seating apparatus according to an embodiment of the invention allows a user to perform restorative and yoga poses, including sitting poses, twistings, forward extensions, backward extensions and supine poses. More specifically, the apparatus of the present invention facilitates such poses while either (a) being typically seated on a swivel chair at a desk while, for example, operating a computer, performing clerical and office work, or (b) utilizing such chair nearby the desk while pausing, relaxing, exercising and energizing momentarily between tasks.

In accordance with an example of the invention the seating apparatus of the invention may be provided with a set of exercise instructions. The instructions may be provided in one or more of printed format; in an electronic format, e.g. in the form of an accessible Internet site or a data carrier carrying a set of computer executable instructions; in the form of vide; or in an audio format.

Figure 1A:
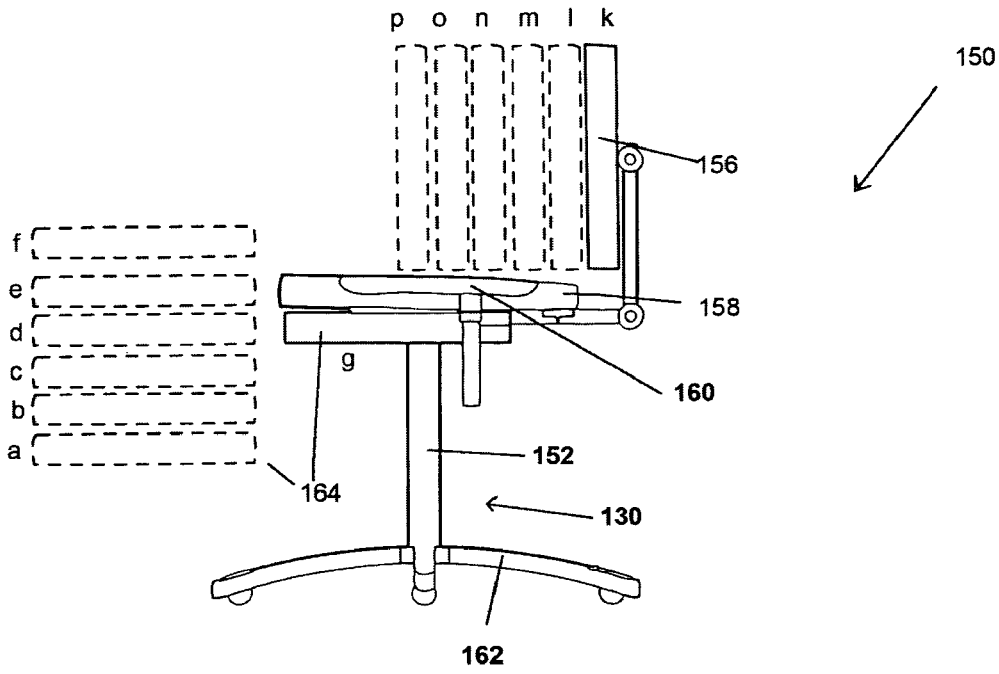
FIG. 1*a* is a simplified schematic illustration of a side view of a seating apparatus having an adjustable leg support (also referred to herein also as "lower support element") being selectively vertically moveable to different parallel horizontal positions and an adjustable back support being selectively horizontally moveable to different parallel positions, according to some embodiments of the present invention.

Reference is now made to FIG. 1*a*, which is a simplified schematic illustration of a side view of a seating apparatus generally designated 150, according to one example of the invention, having an adjustable leg support, or lower support element 164 being selectively vertically moveable to different positions.

FIG. 1*a* shows a lower support element 164, stored under seat 158 in position "g" and adjustable to several different positions (a to f). Positions a-d are lower than the level of the seat. Position e is substantially at the same level of the seat and position f is above the level of the seat.

FIG. 1*a* further shows an adjustable back support 156 being selectively horizontally moveable to different parallel, generally vertically-oriented positions (k, 1, m, n, o and p) according to some embodiments of the present invention.

Apparatus 150 comprises two armrest elements 160 and at least one frame element 130, typically comprising a base 162 and a vertical support member 152 extending vertically therefrom.

Examples of means for adjusting the lower support element, include, but are not limited to the arrangements described hereinbelow. Designing a mechanism for adjusting the position of the lower support element is a feat easily attainable by a person versed in the art. The mechanism may also comprise means for locking the position of the lower support element.

Figure 1B:
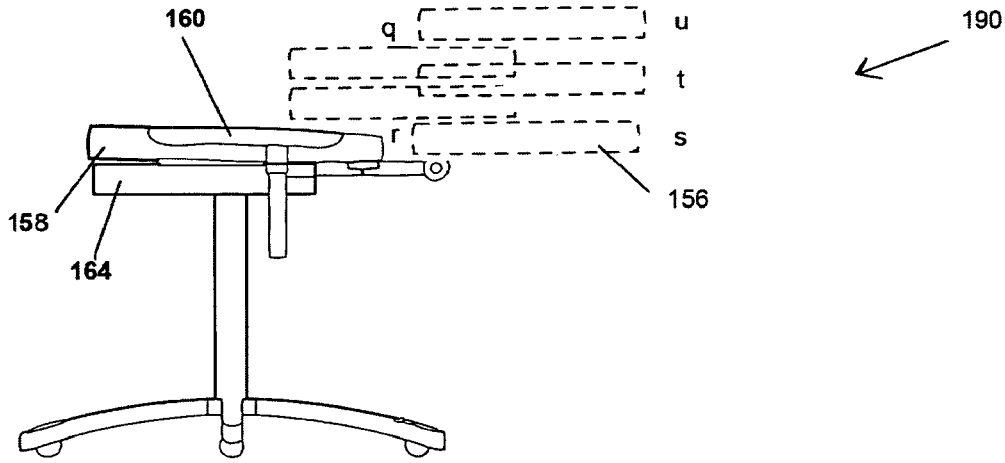
FIG. 1*b* is a simplified schematic illustration of a side view of a seating apparatus having an adjustable back support being selectively moveable to different positions, according to some embodiments of the present invention.

Reference is now made to FIG. 1*b*, which is a simplified schematic illustration of a side view of a seating apparatus 190 having an adjustable back support 156 that can be rotated from a generally vertical, orientation to an essentially horizontal one and which can be selectively horizontally and vertically moved to different sets of parallel positions (q and r; and s, t and u), according to some embodiments of the present invention.

Figure 1C:
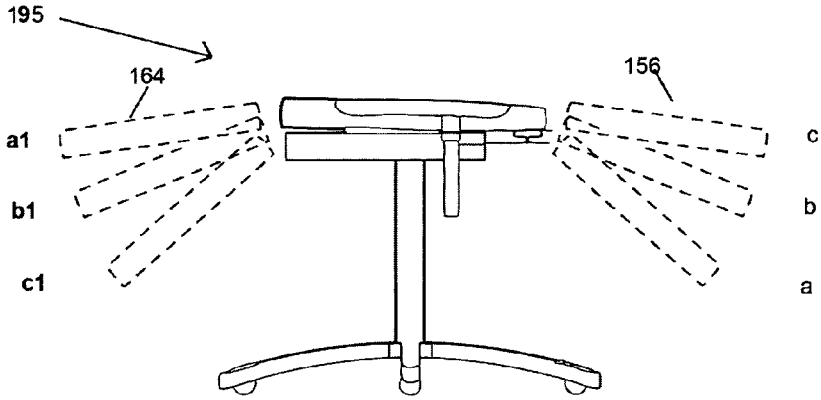
FIG. 1*c* is a simplified schematic illustration of a side view of a seating apparatus having an adjustable leg support being selectively moveable to different angular positions and an adjustable back support being selectively moveable to different angular positions, according to some embodiments of the present invention.

Reference is now made to FIG. 1*c*, which is a simplified schematic illustration of a side view of a seating apparatus 195 having an adjustable lower support element 164 being selectively moveable to different angular positions ($a_1$, $b_1$, $c_1$) and an adjustable upper support element 156 being selectively moveable to different angular positions (a, b, c) according to some examples of the present invention.

Figure 1D:
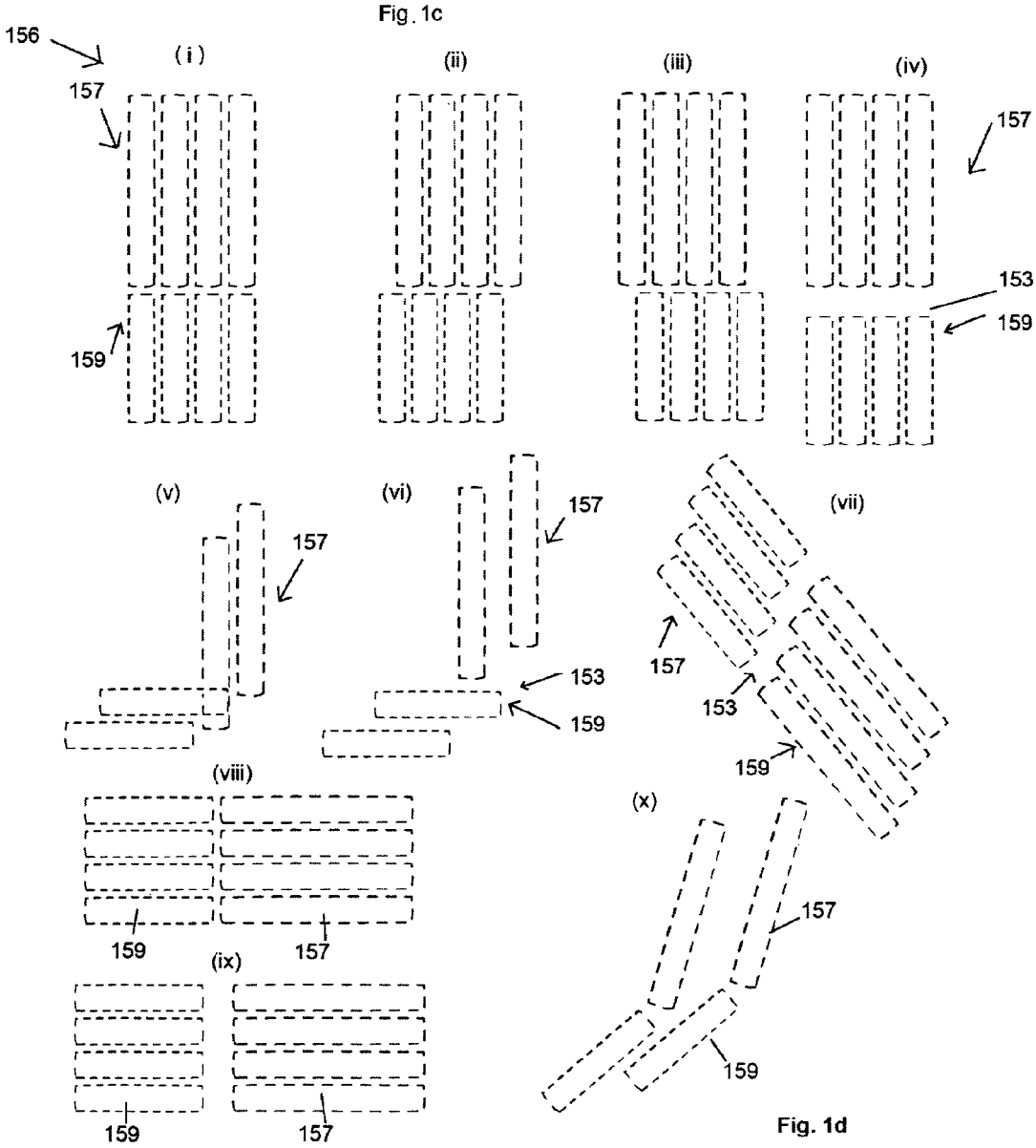
FIG. 1*d* is a simplified schematic illustration of an adjustable back support comprising an upper element and lower element, both elements being selectively moveable, according to some embodiments of the present invention.

Reference is now made to FIG. 1*d*, which is a simplified schematic illustration of an adjustable back support or upper support element generally designated 156 comprising two portions—an upper portion 157 and lower portion 159, the position or orientation of both portions is independently adjustable versus the seat or versus the other portion, according to some embodiments of the present invention. Some examples of the versatility of the upper support element are described hereinbelow.

In a first case (FIG. 1*d*(i)), the upper and lower portions are vertically aligned and can be moved together along a horizontal axis such as leftwards or rightwards.

In a second case (FIG. 1*d*(ii)), the upper portion may be displaced out of alignment with the lower portion, such as so that its lower end falls behind the upper end of the lower portion, thus reducing the total height of the upper support element, or in turn accentuating the support of the pelvis or sacral region of the pelvis as compared to the upper back. In some cases, the two portions have one point or area of contact. In other cases, there is a small distance between the portions. The two portions may be horizontally displaced in this relative position.

In a third case (FIG. 1*d*(iii)), the upper portion may be displaced out of alignment from the lower portion in the opposite relative direction than FIG. 1*d*(ii). The two portions may be horizontally displaced in this relative position.

In a fourth case, (FIG. 1*d*(iv)), the upper portion may be displaced above the lower portion, with a vertical distance or gap 153 between the two portions. The upper and lower portions are vertically aligned and can be moved either together or separately along a horizontal axis, such as leftwards or rightwards.

In a fifth case, (FIG. 1*d*(v)), the upper portion 157 and the lower portion 159 are brought in a relative right-angle orientation, with the lower portion 159 being parallel to the seat (not shown) and the upper portion 157 being perpendicular thereto. In FIG. 1*d*(vi) the relative orientation is the same but with a gap 153 between the portions. The upper and lower portions are vertically aligned and can be moved either together or separately along a horizontal axis, such as leftwards or rightwards.

In a seventh case, (FIG. 1*d*(vii)), the upper support element can be oriented to assume an acute or obtuse angle to the rear end of seat, with the two portions being aligned at the same angle to the seat with a fixed or, varying gap 153 between the two portions. The two portions may be moved together in a general vertical direction, relative to the seat (not shown).

In an eighth and ninth case, (FIG. 1*d*(viii) and FIG. 1*d*(ix)), the upper 157 and the lower 159 support elements are oriented into a generally horizontal orientation, with the latter differing from the former in the gap between the respective elements. The two elements can now be displaced in the vertical direction.

In a tenth case, (FIG. 1*d*(x)), the upper portion 157 is at an obtuse angle to the lower portion 159 and can be displaced with respect to the seat in this relative orientation.

The seat, frontal support and backrest elements of the arrangement as described herein can be adjusted angularly and translationally thereby to support various seating positions including kneeling, and various Yoga sitting and backward extension and restorative poses. The seat element may be supported by a swiveling support element, which in turn is fixed to a wheeled support structure, as often used in ordinary office swivel chairs. The frontal support element is supported also by the vertical support element, and in addition may also be independently elevated, tilted and revolved with respect to the seat element. The backrest element may be tilted and translated with respect to the seat element and is connected to the seat element along its bottom end.

The mechanism for changing position or orientation of the different elements, and at least the position orientation of the seat element, may, according to an example of the invention, include some remotely operated motors that are associated with the different elements for changing their position or orientation. Such a motor may be a pneumatic motor, a hydraulic motor, or an electric motor, energized by the appropriate source of energy. The seating and exercise apparatus may, according to an example of the invention, comprise a control arrangement, e.g. a switching mechanism, for controlling the position orientation of the different elements. The control mechanism may, according to an example of the invention, be automatic. An automatic mechanism may comprise, for example a variety of different states, each one with its characteristic position and orientation of the different elements and by inputting a certain state the respective elements move or orient into the appropriate position.

Figure 1E:
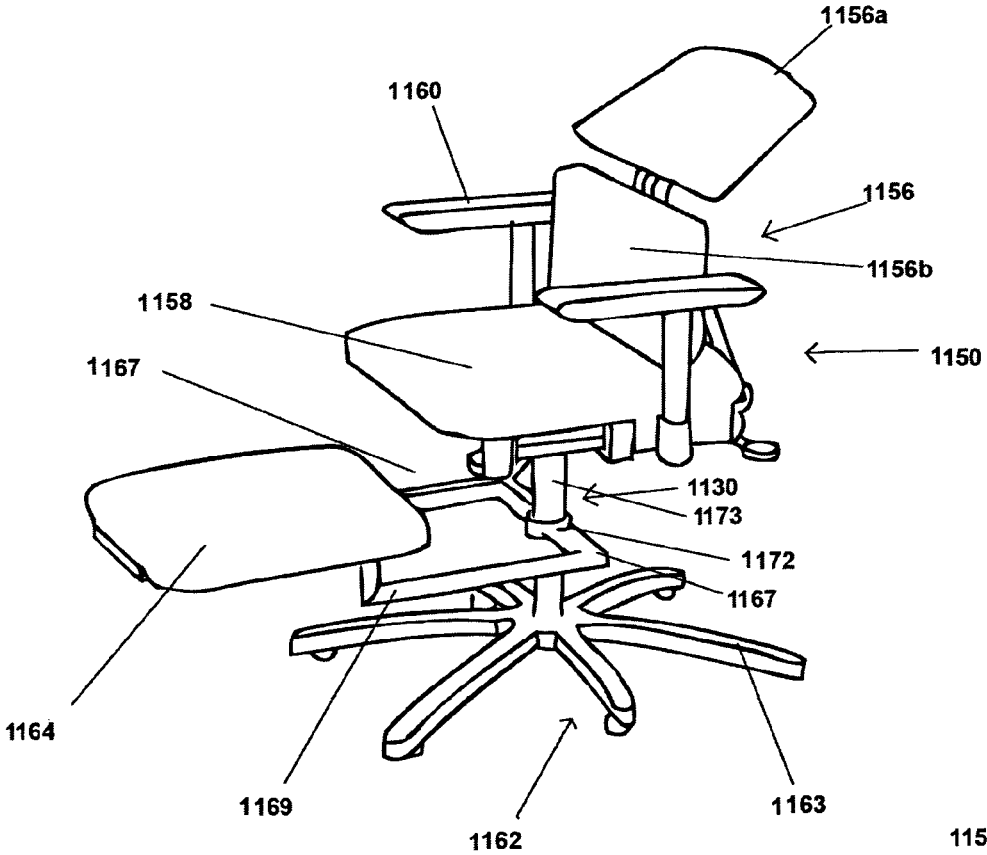
FIG. 1*e* is an illustration of an apparatus according o an embodiment of the present invention having an adjustable leg support for a user in a seated position and a segmented adjustable back support.

In FIG. 1*e* the lower support element 1164 is fixed at the end of support bars 1169 fitting within the annuli of the right and left wings 1167 of "u" shape annular member. The support element 1164 can be extended or retracted by sliding of bars 1169 within hollow wings 1167. The vertical position of support element 1164 may be changed by adjusting the level of fastening annulus 1172 along sleeve 1173 of the seats support structure 1130, through turning of wheel or any suitable arrangement. Additionally, a seating apparatus base unit 1162 comprises one or more long legs 1163 or legs which are extendable, which provide extra stability to the user upon sitting or exercising on the seating apparatus. The upper support element of the back support element 1156*a* is rotated slightly compared to the lower element 1156*b*, thereby optionally providing a backward extension possibility when the practitioner elects to rest or relax momentarily.

Figure 1F:
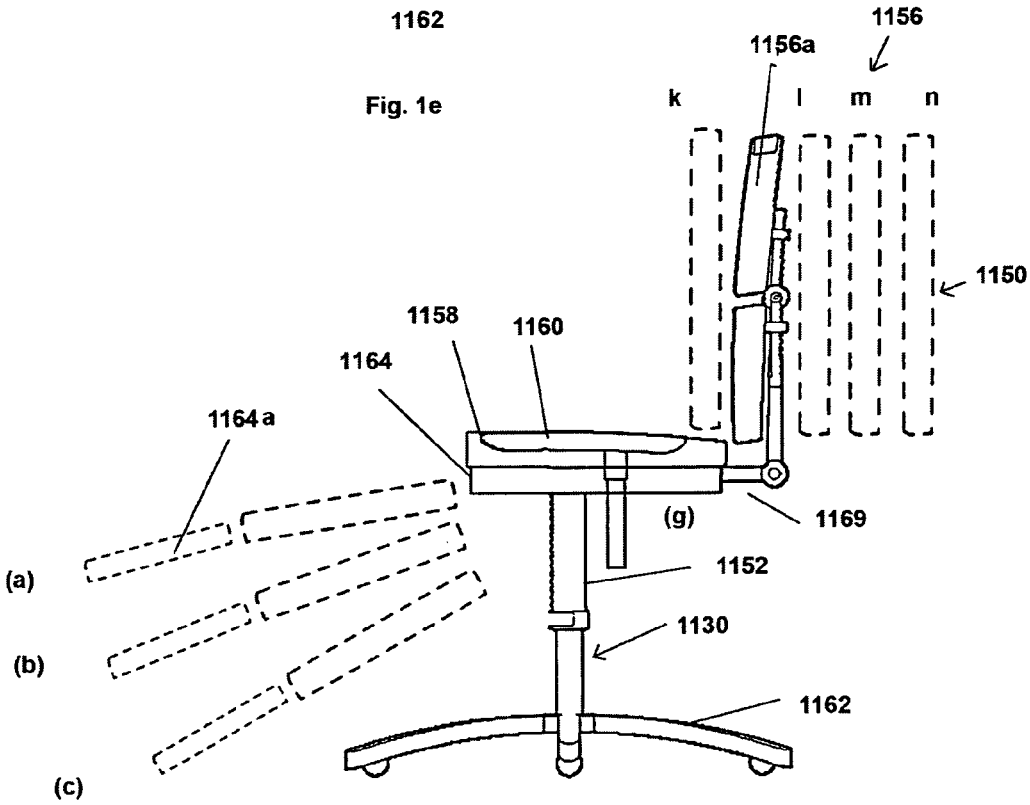
FIG. 1*f* is an illustration of a side view of a seating apparatus having an adjustable leg support for a user in a seated position such as sukasana, the leg support being selectively vertically moveable to different parallel horizontal positions, according to some embodiments of the present invention and an adjustable back support movable to various positions.

Reference is now made to FIG. 1*f*, which is an illustration of a side view of a seating apparatus 1150, according to an embodiment of the invention, having an adjustable leg support, or lower support element 1164 being selectively vertically and horizontally moveable to different positions (a, b and c), according to some embodiments of the present invention.

FIG. 1*f* shows a lower support element 1164, stored under seat 1158 in position "g" and adjustable to several different positions (a to c). Positions a-c are lower than the level of the seat. However, position at the same level of the seat and position above the level of the seat are also achievable. The lower support element 1164 according to this example also comprises and extension 1164*a* which may be stored within or underneath the lower support element and retracted when in use. Such extension 1164*a* may also be a detachably attachable extension to be attached by the use of a hook and pile arrangements such as Velcro™ etc.

Apparatus 1150 comprises two armrest elements 1160 and at least one frame element 1130, typically comprising a base 1162 and a vertical support member 1152 extending vertically therefrom. Apparatus 1150 also includes a back support element 1156.

The adjustable back support 1156 is optionally and selectively horizontally moveable to different parallel, generally vertically-oriented positions (k, l, m and n) according to some embodiments of the present invention.

In accordance with one example of the invention, the seating and exercise apparatus is configured as a platform for supporting the user's body in a variety of positions, particularly yoga positions. Such yoga positions may be selected from swastikasana/sukasana, Siddhasana, badhakonasana, sukasana, Virasana, Vajrasana, adhomuka sukasana, adhomuka vajrasana, adhomuka virasana, adhomuka badhakonasana, maitriyasana, viparita dandasana, and supported uhrdva dhanurasana.

Figure 2A:
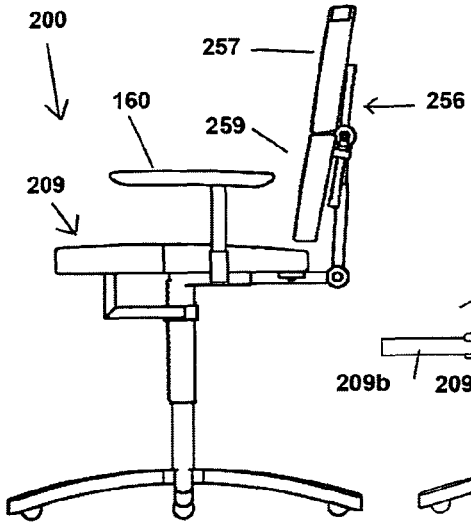
FIGS. 2*a*-2*e* are illustrations of a seating apparatus, according to some embodiments of the present invention, adjusted for a sitting pose (FIG. 2*a*) and various restorative poses (FIGS. 2*b*-2*e*)

Reference is now made to FIG. 2*a*, which is an illustration of a side view of a seating apparatus 200 having an adjustable back support 256 that can be displaced/rotated from a generally vertical orientation (FIG. 2*a*) to an essentially horizontal (FIG. 2*b*) one and which can be selectively horizontally and vertically moved (FIG. 2*e*) to different sets of positions according to some embodiments of the present invention.

The back support or upper support element 256 in FIG. 2*a* comprises two portions—an upper portion 257 and lower portion 259, the position or orientation of both portions is independently adjustable versus the seat or versus the other portion, according to some embodiments of the present invention. Some examples of the versatility of the upper support element are described hereinbelow.

FIGS. 2*a*-2*e* further show the seating apparatus 200 comprising a rear part of a seat 258, a front part of a seat 209, wherein the front part 209 is configured to be a lower support element, which can be lowered below the horizontal plane of the seat and maneuvered about an angle relative to the horizontal plane of the rear part 258. Front part 209 may be used in some configurations to support the torso, and in other configurations to support the legs and feet of the user.

In FIG. 2*a* the upper and lower portions are vertically aligned and can be moved together along a horizontal axis such as leftwards or rightwards.

The upper portion may be displaced out of alignment with the lower portion, such that its lower end may fall if desired behind the upper end of the lower portion, thus reducing the total height of the upper support element. In some cases, the two portions have one point or area of contact. In other cases, there is a small distance between the portions. The two portions may be horizontally and vertically displaced in this relative position.

Figure 2B:
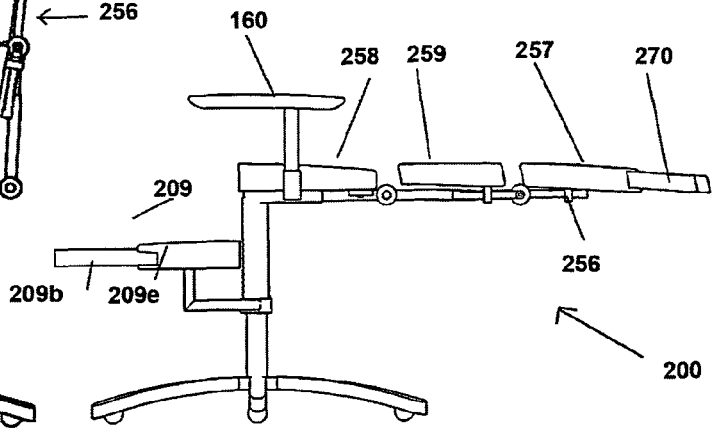
Figure 2C:
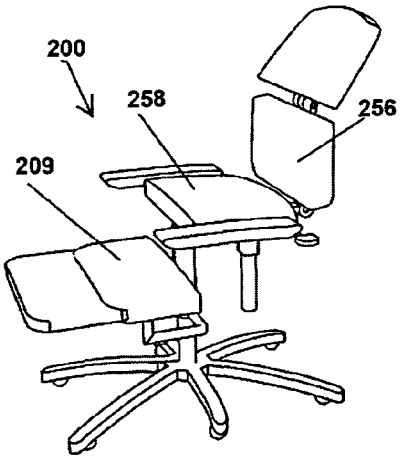
Figure 2D:
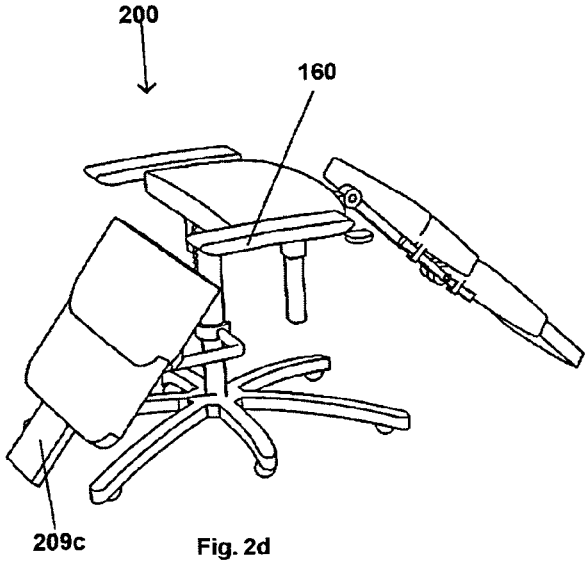
Figure 2E:
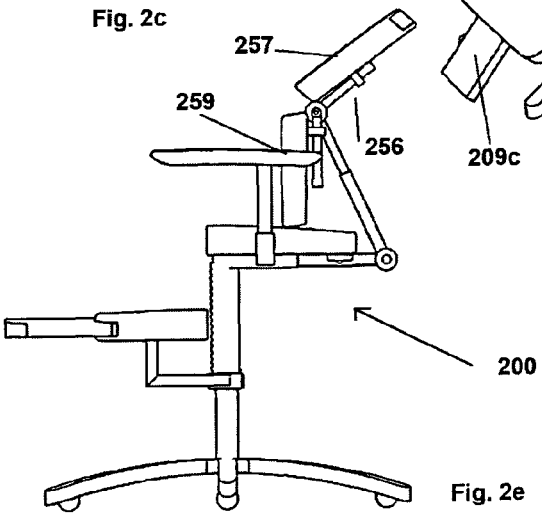

In FIGS. 2*c* and 2*e* the upper support element can be oriented to assume an acute or obtuse angle to the rear end of seat, with the two portions being aligned at the same angle to the seat with a fixed gap between the two portions. The two portions may be moved together in a general vertical direction, relative to the seat 258.

In FIG. 2*c*, the upper portion 257 is at an obtuse angle to the lower portion 259 and can be displaced with respect to the seat 258 in this relative orientation.

As shown in FIGS. 1*e* and 1*f* and 2*a-e* for example, at least one arm rest 160 is selectively moveable, according to some embodiments of the present invention. Arm rest 160 may be moved vertically or horizontally into the positions seen in the figures, or instead may be rotated vertically about horizontal axis or may be vertically translated along a vertical railing axis downwards Typically, in seated positions, such as for example in the Yogic sitting postures of sukasana and badhakonasana, the sitting bones are moved forward towards the front edge of the seat, and the lower support element 259 is brought forward towards the edge of seat 258, in which case the user has a much smaller effective seating area available to him (FIG. 2*e*).

FIG. 2*b* is an illustration of a side view of a seating apparatus adjusted for a user in a variety of restorative supine poses (e.g. supta-sukasana, supra-badhakonasana), according to some embodiments of the present invention. As shown in FIG. 2*b*, the apparatus may further be provided with a neck support extension 270. In such position, the arm supports 160 may be lowered below the seat in a lower position (FIG. 2*c*), thereby allowing the arms to loosen to the sides, or crossed arms over the head for better extension and broadening of the chest.

Additional examples as shown in FIGS. 2*b* and 2*d* illustrate a lower support element 209 comprising two (FIG. 2*b*) or three (2*d*) segments 209*a*, 209*b*, 209*c*, with a degree of freedom between them to assume a geometrical arrangement in which they are angled one with respect to the other, thereby providing a combined lumbar support and dorsal and thoracic back support in a reverse sitting or lying positions. By "reversed sitting" or "reversed lying" is meant that the person's back portions of the body are facing at least one of the seat, upper support element and lower support element.

FIG. 2*e* is an illustration of a side view of a seating apparatus 200 adjusted for a user for example in a Yogic sitting posture sukasana according to some embodiments of the present invention, whereby the user's legs are crossed and positioned on top of the frontal support element 209, the sitting bones and buttocks placed on the seat element 258, the and lower back support element 259 supporting the sacral region of the pelvis. By angularly positioning the upper back support element 257, the user can further extend backwards his upper back thereby providing a semi-supine restorative and energizing posture. FIG. 2*d* is an illustration of the seating apparatus 200 adjusted for a user in a back-bend leaning pose, according to some embodiments of the present invention. FIG. 2*d* provides a restorative, back-bending support whereby both a lower support element 209 and an upper support element 256 are manipulated so as to provide support to the entire length of the person's back.

FIGS. 3*a*-3*g* show perspective and side views of an example of a seating apparatus 300, comprising a lower support element 310 which is an integral part of the seat (front half of the seat) when positioned in the plane of the rear part of the seat 311, and wherein the lower support element 310, by utilizing crank element 312, can be lowered to various planes below the plane of the rear half of the seat in accordance with an example of the present invention.

Figure 3A:
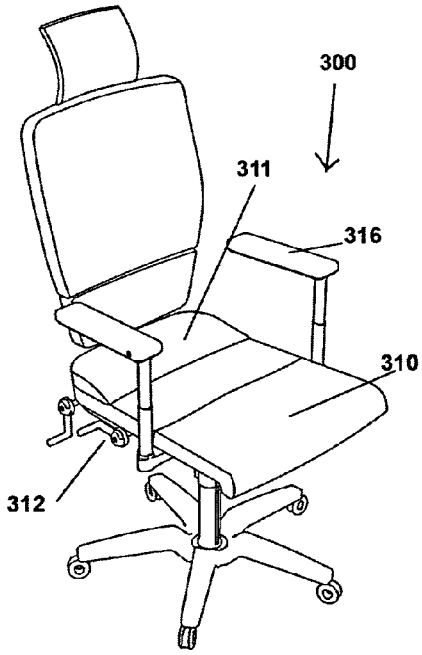
FIGS. 3*a*-3*g* are illustrations of a seating apparatus, according to some embodiments of the invention, adjusted for a sitting pose (FIG. 3*a*) and various restorative poses (FIGS. 3*b*-3*g*)
Figure 3B:
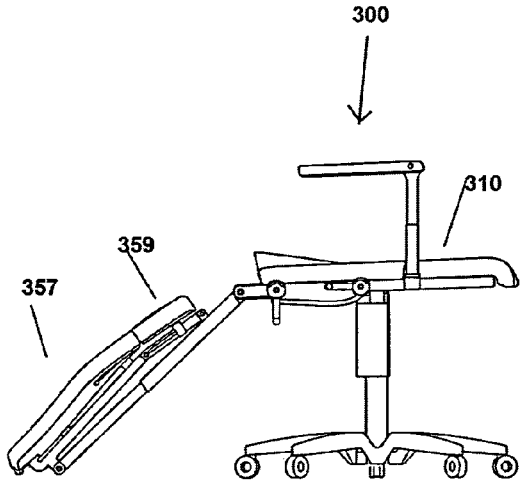
Figure 3C:
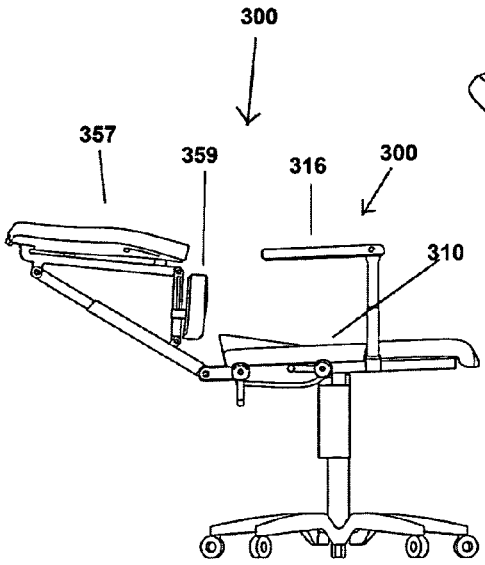
Figure 3D:
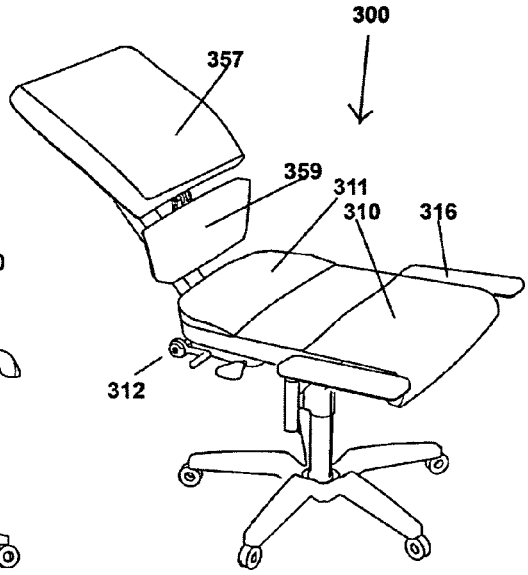
Figure 3E:
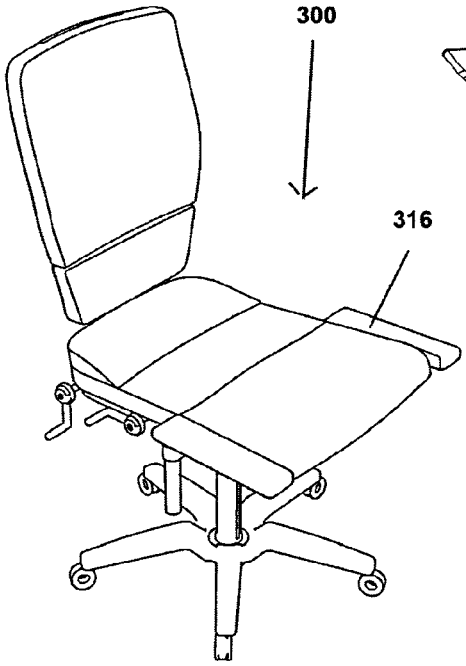
Figure 3F:
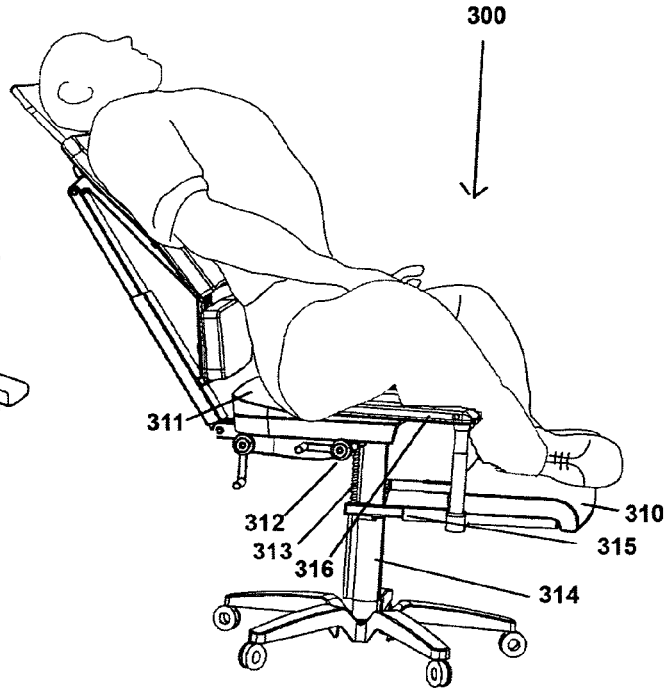
Figure 3G:
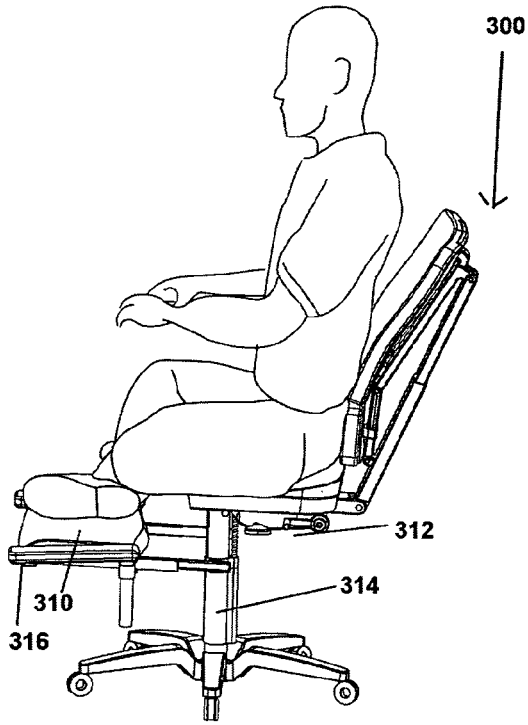

FIG. 3*f* depicts the lower support element 310 positioned slightly below the plane of the rear half of the seat 311 and whereby the armrests 316, which are connected to the lower support element 310, are lowered and revolved to a preferred position thereby supporting then side shins of the user when seated in the Yogic seating posture badhakonasana. The elevation plane of the lower support element 310 is controlled by crank element 312 which turns a horizontal axle, which in turn turns a vertically oriented grooved axle element 313, resulting in the vertical translation of the encapsulating threaded pipe element 314, which is also rigidly connected and supports a retracting telescopic support railing element 315. Railing element 315 supports the lower support element 310 in all elevation and extended positions. FIGS. 3*a*-3*f* further depict various variations of the back support elements 357 and 359, the arm rests 316 and illustrate Yoga positions (FIGS. 3*f* and 3*g*)

This configuration of the seating apparatus is particularly suitable for performing yoga exercises such as seated poses sukasana, swastikasana/sidhasana, badhakonasana, forward extension seated poses such as adhomukha sukasana, adhomukha swastikasana/sidhasana, and adhomukha badhakonasana. Beginners sitting in cross legged sukasana will tend to position the lower support element 310 in a lower elevation to accommodate stiffness in their pelvis, femur joints, knees and feet, while advanced users will increase the elevation such that the plane of the lower support level 310 will be closer to the plane of the rear part of the seat 311. Taller users will also tend to extend the lower support element 310 further outwards to accommodate their longer thighs. In each of the elevation and extension positions of the lower support element 310 the armrest elements 316 can be independently raised from the plane of the lower support element 310 and rotated about their respective vertical axis to provide thigh and shin supports for prolonged sitting and in restorative postures and situations.

Figure 4A:
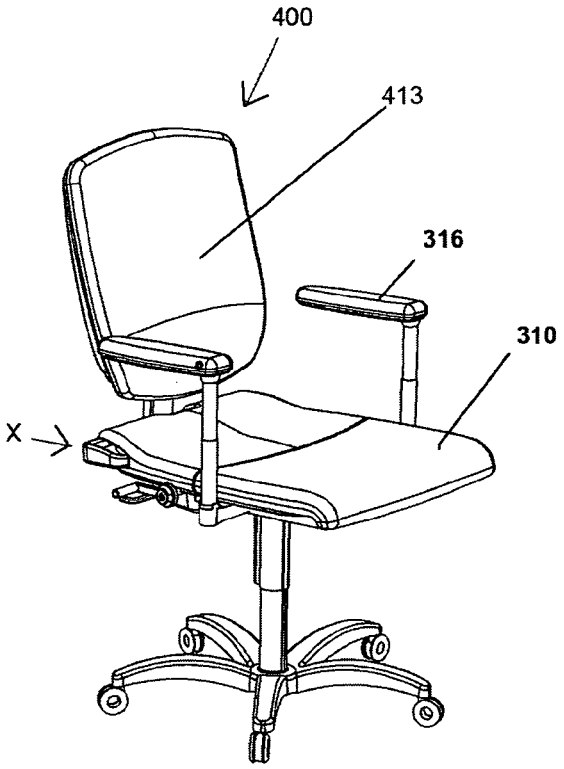
FIGS. 4*a*-4*c* are illustrations of a seating apparatus, according to some embodiments of the invention, adjusted for a user in several sitting and restorative poses.
Figure 4B:
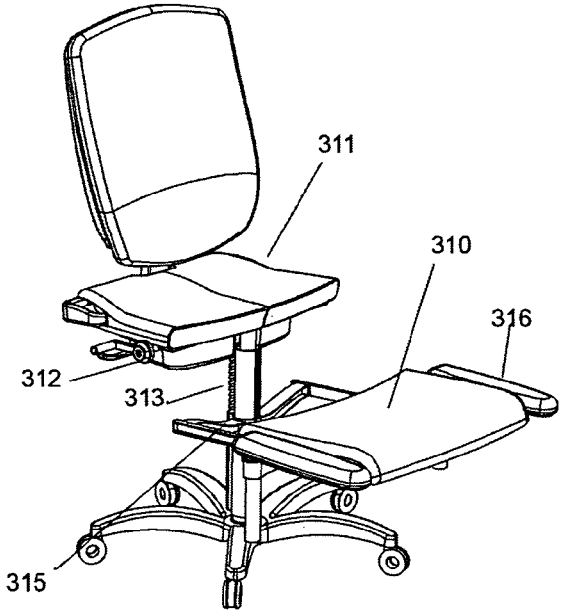
Figure 4C:
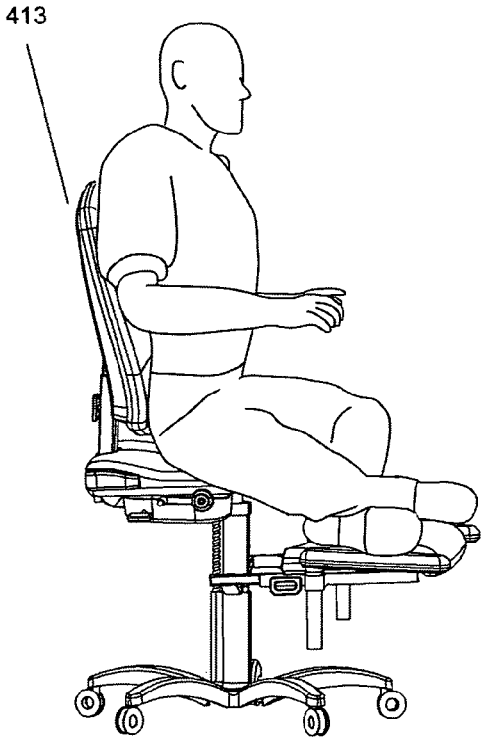

Shown in FIGS. 4*a*-4*c* is an illustration of an additional example of a seating arrangement according to the present invention. The seating arrangement 400 provides for a seating arrangement similar to the arrangement of FIGS. 3*a-f*, with a modification of a slideable (in the direction of arrow X) back support 413 from an initial position illustrated in FIG. 4*a* to a possible position as illustrated in FIG. 4*c*. The backrest position can be adjusted horizontally thereby providing increased support to the pelvic area in general and to the sacrum in particular, such that when lowering the frontal support element and while seated in yogic sitting positions such as Sukasana or badhakonnasana, the pelvis is supported more effectively by the forward positioning of the backrest. In order to enable such adjustment even further, a curved area in the back seat is left open to receive the backrest support structure, in accordance with an embodiment of the present invention. Handrests on the back sides of the seat may be added to improve the user's ability to seat himself properly in yogic sitting positions. This is especially useful when the frontal support element 310 is lowered together with the armrests.

Figure 5A:
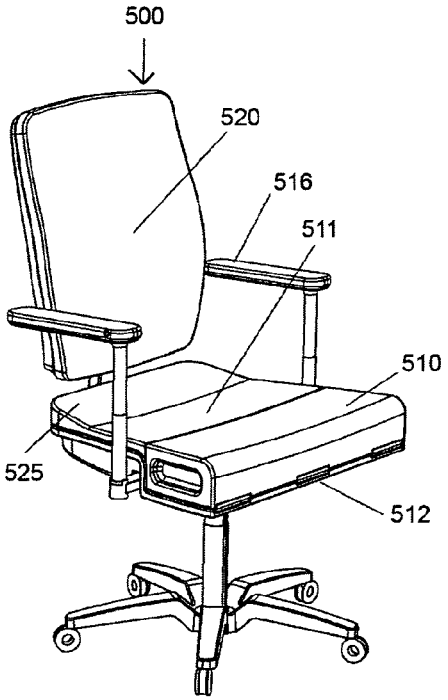
FIG. 5*a*-5*d* are illustrations of a seating apparatus, according to some embodiments of the invention, adjusted for a user in several sitting and restorative poses.
Figure 5B:
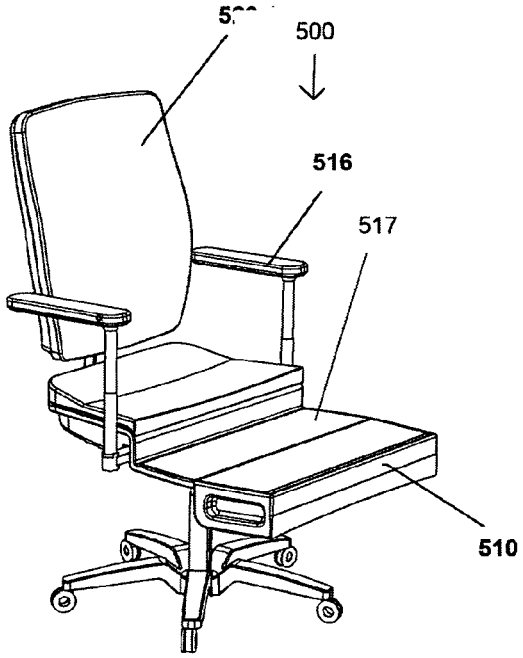
Figure 5C:
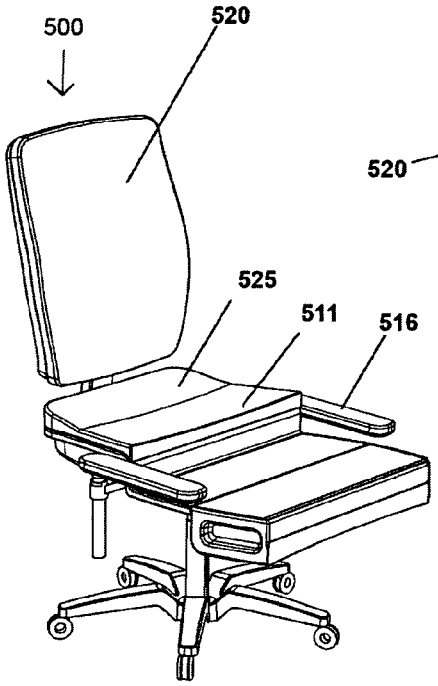
Figure 5D:
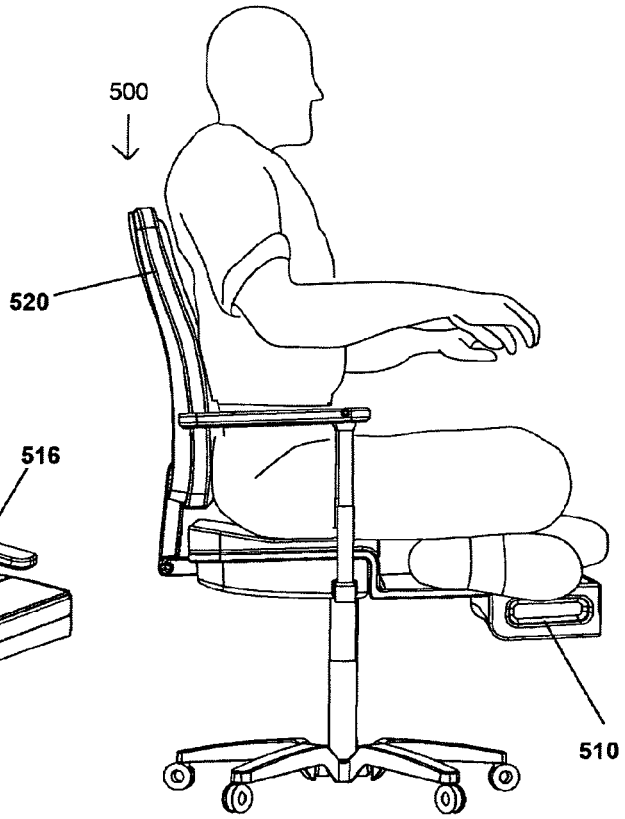

FIGS. 5*a*-5*c* illustrate yet another example of a seating apparatus of the present invention. As exemplified in FIG. 5*a*, seating apparatus 500 comprises a seat portion with front 510 and rear 511 segments; the front segment 510 having a first, regular seating position (FIG. 5*a*) in which a top face thereof is level with a top face of the rear segment 511 so that the top faces of both segments jointly define an essentially planar seating surface; and having a second position (FIGS. 5*b*-5*d*) in which the seat is configured to have a first, seating surface defined by said rear segment 511 and a second surface essentially parallel to and at a level lower than said first surface defined by said first segment 510. In accordance with one embodiment said front segment is switched between the two positions in a pivotal manner, typically about a pivot 512 at a front end of the seat. In its first position the front segment 510 may rest on a base with a bottom face of the front segment being in contact and facing a top face of the base. Upon a pivoting switch to said second position the initially bottom face of the front segment becomes the top face defining jointly with the top face of the base said second surface.

As in previous examples the backrest 520 is displaceable to various vertical and horizontal positions and may be also segmented to provide various support positions. The rear part of the seat may be provided with an elevation cushion 525 which may be an integral part of the seat or a detachably attachable element, thereby providing a suitable forward tilting angle of the user's pelvis in Yogic sitting postures. The chair seat with the frontal element in the folded position can be used for conventional sitting, and by unfolding the front seat element, frontal support element is provided with elevation for comfortably supporting the legs in yogic sitting positions such as Sukasana and Badhakonnasana, in accordance with an example of the present invention FIGS. 6*a*-6*i* illustrate still an example of the present invention. The seating arrangement 600 is a modification of the seating arrangement 400, the exemplified arrangement comprises an adjustable headrest, adjustable armrests, and an adjustable frontal support element which comprises, in addition to the lowering and extending adjustments, also additional sideways opening flaps 613 for providing extended lateral area for feet, shins and knees support for yogic sitting positions such as Sukasana and sidhasana. The flaps 613 can also be locked in various angular positions thereby enabling supporting the sides of the shins and thighs in sitting positions such as badhakonnasana.

FIG. 6*b* illustrates a preferred headrest embodiment of he present invention, whereby the headrest is designed to support the head in regular sitting positions, while fully supporting the entire nape line of the lower, mid and upper neck in various restorative Yogic backward extension postures and supine postures. The headrest arrangement enables both lengthwise extension of the headrest with respect to the backrest element 620 and also enabling a rotative adjustment suitable for varying height and flexibilities of users in the upper back and shoulder girdle.

Figure 6A:
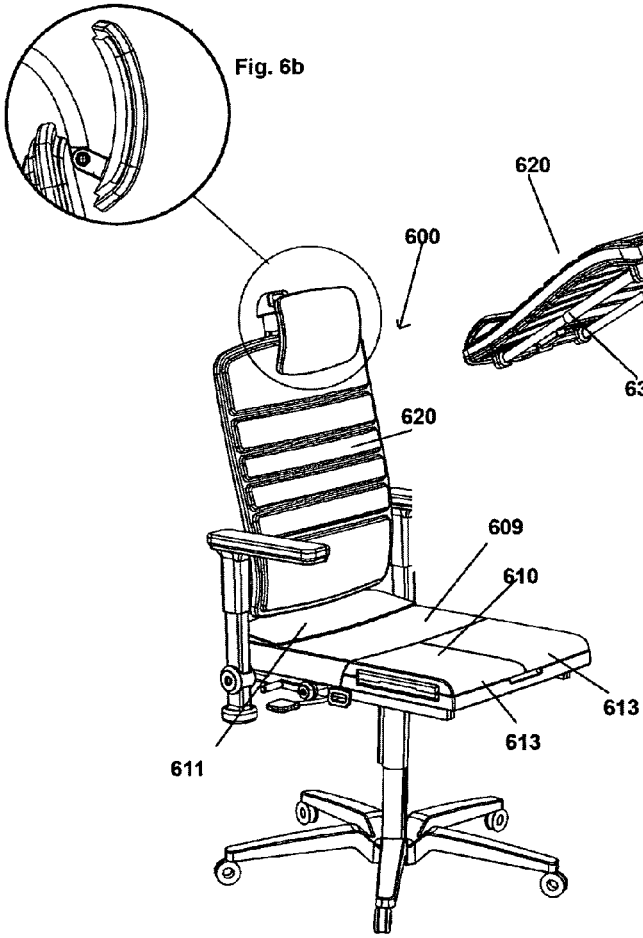
FIG. 6*a* is an illustration of a seating apparatus adjusted for a seating pose in accordance with an embodiment of the present invention.
Figure 6C:
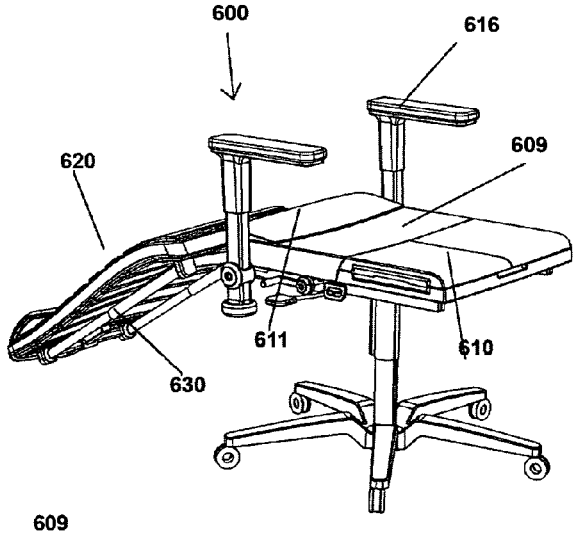
FIGS. 6*c*-6*e* illustrate a seating apparatus, according to some embodiments of the invention, adjusted for a user in a substantially backward tilted leaning pose.
Figure 6D:
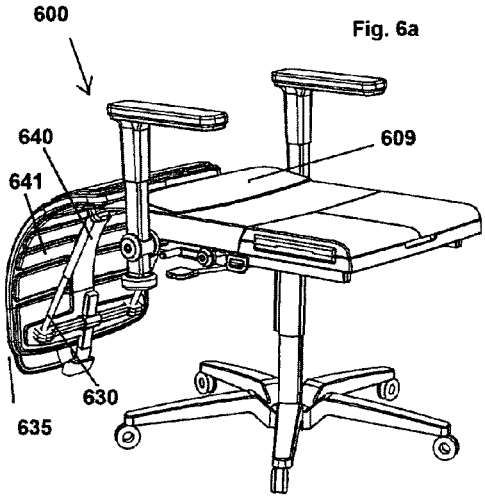
Figure 6E:
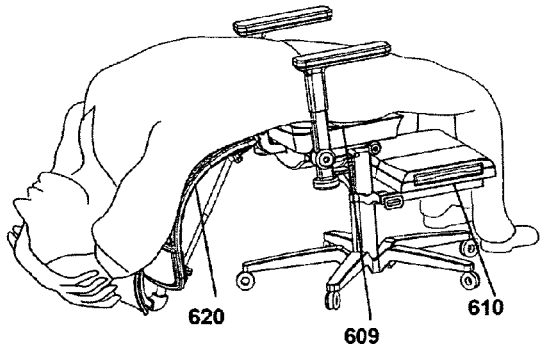
Figure 6F:
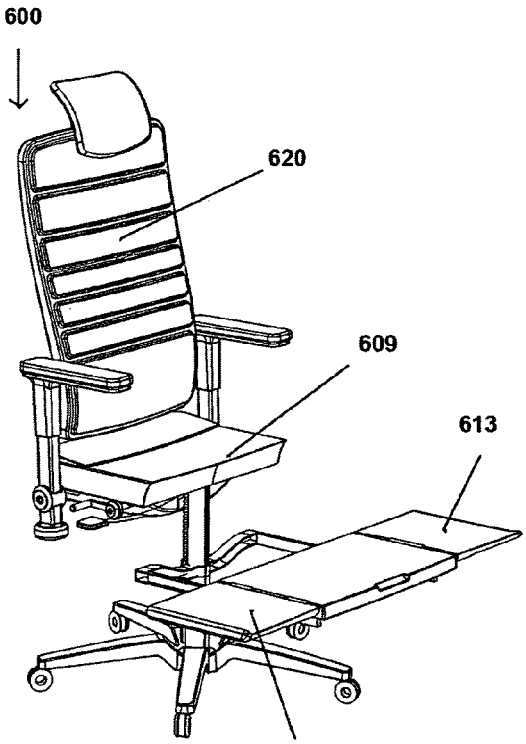
FIGS. 6*f*-6*i* illustrate a seating apparatus according to some embodiments of the invention, the seating apparatus comprising a segmented lower support element which is an integral part of the seat (front half of the seat), wherein the lower support element is below the plane of the rear half of the seat adapted to further deployment for supporting the thighs and/or the knees of the user.
Figure 6G:
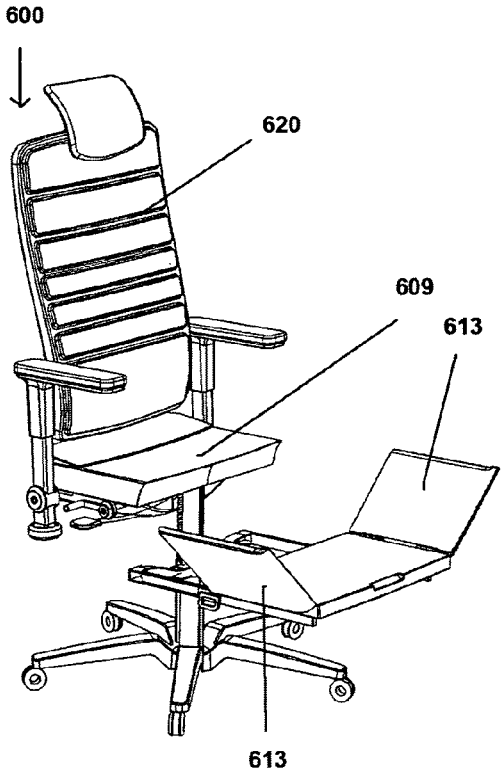
Figure 6H:
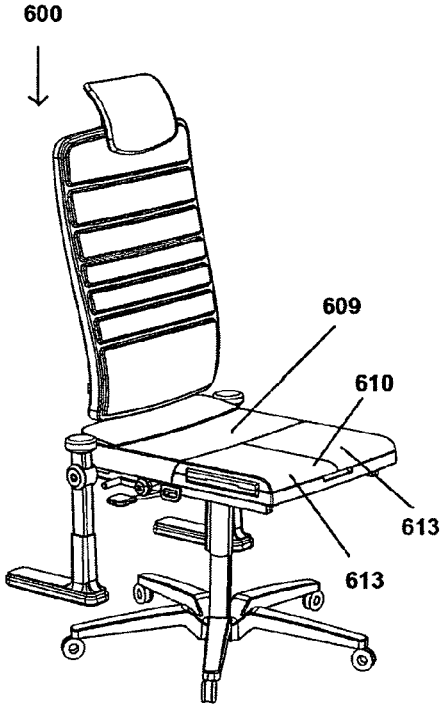
Figure 6I:
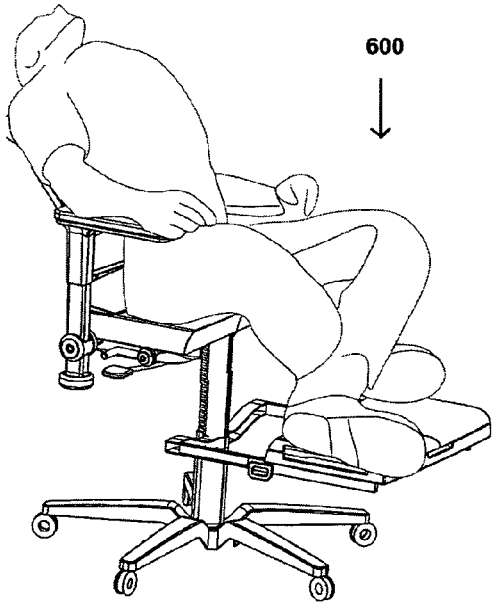

The arrangement exemplified in FIGS. 6*a*, 6*c*, 6*d* further comprises a continuous angular and curvature adjusting backrest 620, thereby providing a wide set of restorative yogic positions. The multiply-segmented backrest support 620 comprises a flexible spinal support structure 640 and multiple lateral ribs 645, which are adapted to receive various shapes in order to match the anatomy of the back of the user in various exercise and relaxation positions. For example, in FIG. 6*c* the back 620 is repositioned to lie behind the, and under the plane of, the seat 609. The back support 620 may be bent to a configuration illustrated in FIG. 6*d* to support a position of the user as illustrated in FIG. 6*e*. The back is shaped/bent using a mechanism adapted to telescopically shorten the telescopic support rods 630. The arrangement may be provided with one or more telescopic rods 630. The rear side of the back support is provided with optional reinforcement ribs 635 as best seen in FIG. 6*d*. The flexibility of the spinal support structure 640 can be further adjusted at various locations along its axis to adapt to the flexibility and adeptness of the user.

Figure 7A:
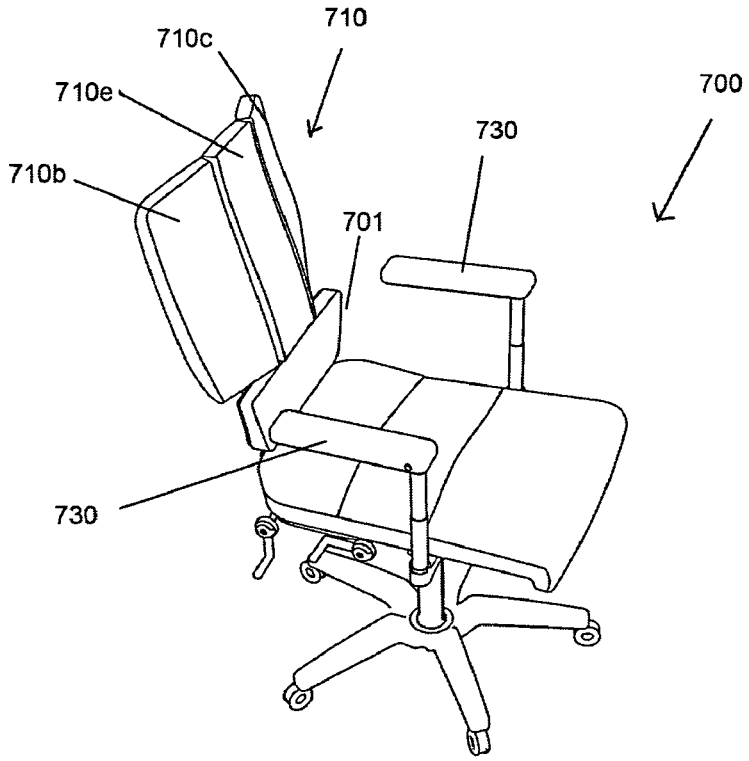
FIGS. 7*a*-7*b* is an illustration of a seating apparatus comprising a segmented back support for supporting the lower shoulder blades and the spine in sited position, according to some embodiments of the present invention.
Figure 7B:
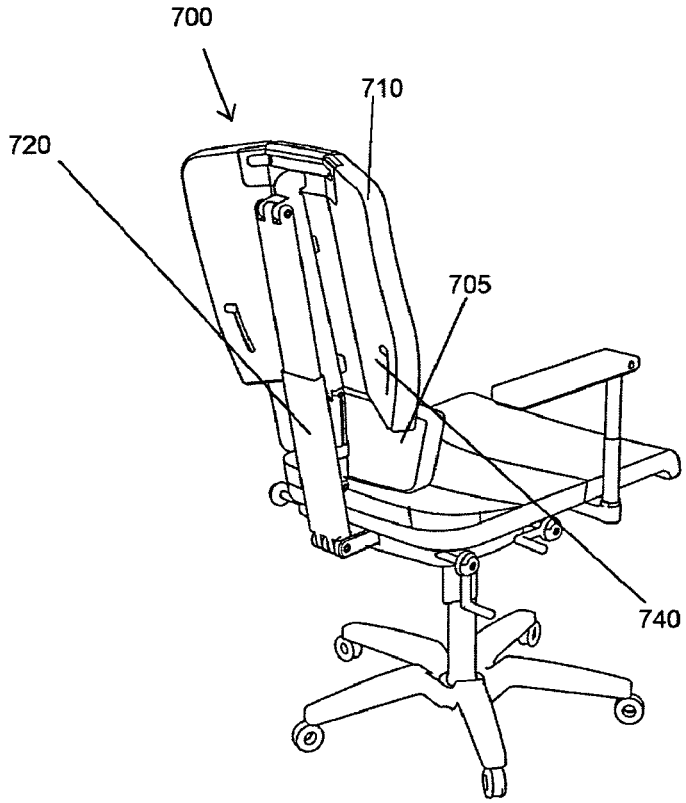

FIGS. 7*a*-7*b* show perspective front and back views of a seating apparatus 700 comprising a segmented (or optionally, regular) seat element 701 as exemplified above, and a back support element comprising an upper 710 and lower 705 support element, whereby the upper 710 and lower 705 back support elements are connected to each other and to a retracting back support rod 720, and whereby two armrests 730 are connected to the sides of the rear of the lower support element are positioned for a regular seating position. The upper back support element is segmented into three sections 710*a*, 710*b*, 710*c* each movable with respect to the other in various angular configurations by the control of sliding elements 740. Such structure of the back rest provides for an accentuated spinal upper back support such that in sitting and supine yoga poses the mid and upper spine is fully supported, and whereby the shoulders and shoulder blades are allowed to move backwards thereby enabling an increased broadening and opening of the chest.

Reference is now made to FIGS. 8*a*-8*f* which illustrate still another example of a seating and exercise apparatus 800 comprising a buttocks support panel 810, a frontal and shin support panel 820, a sacral support panel 830, and a support strut 840, and leg and wheels assembly 850 jointly defining the apparatus's support structure. The support strut 850 may be of a fixed length or may be of an adjustable length, e.g. through a pneumatic telescopic arrangement.

The orientation of buttocks support panel 810 can be angularly adjusted by tilting about a pivot arrangement 812 that is fixed to support strut 840 and then locked at discrete orientations. Fixed to support strut 840 is a beam 822 holding panel 820 through a coupling arrangement 821 (best seen in FIG. 8*d*) enabling a pivotal adjustment in angular orientation and a lateral translation in a plane parallel to that defined by panel 820 to discrete locked states. The level of beam 822 and hence that of panel 820 may be adjusted, for example by the use of a mechanically operated revolving crank.

Figure 8A:
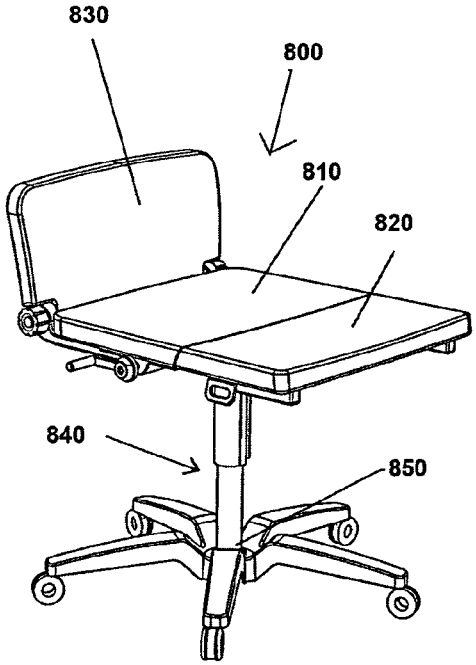
FIG. 8*a*-8*j* is an illustration of a seating apparatus adjusted for a user in various kneeling, yogic and sitting poses, according to some embodiments of the present invention.
Figure 8B:
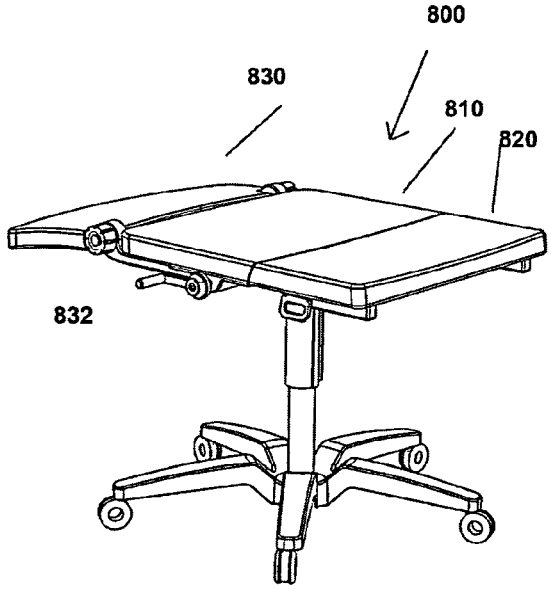
Figure 8C:
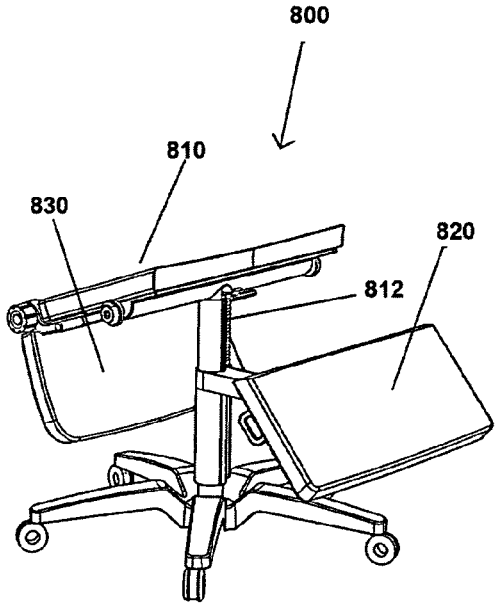
Figure 8D:
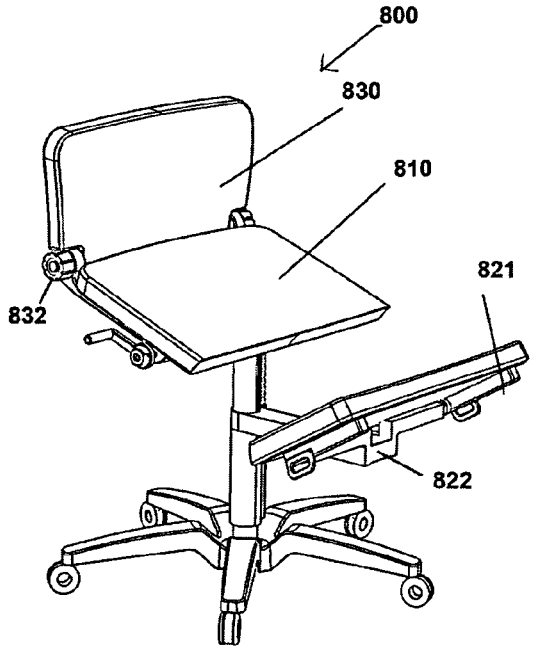
Figure 8E:
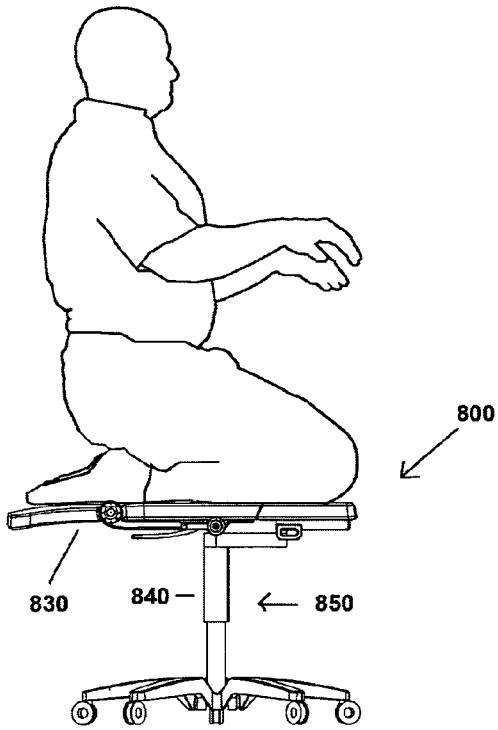
Figure 8F:
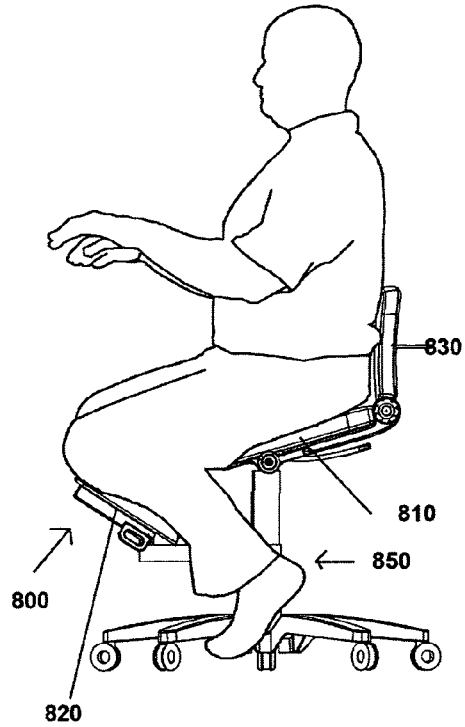
Figure 8G:
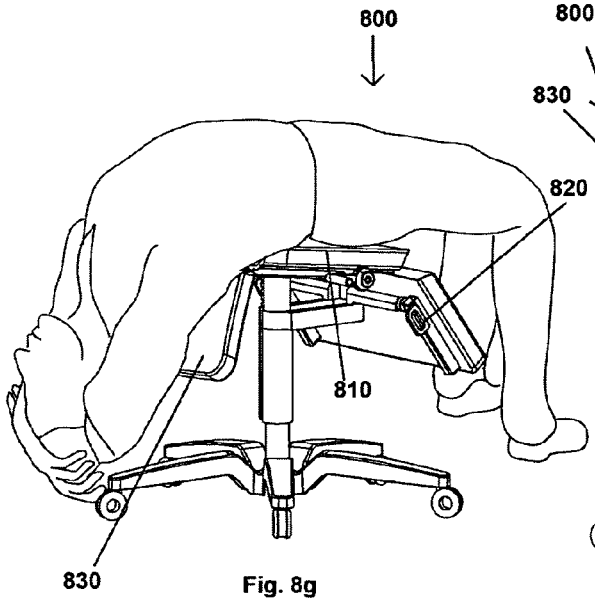

The lumbar support panel 830 is pivotally connected at the rear side of panel 810 about a pivot arrangement 832 and may be tilted to discrete locked angles with respect to panel 810 (see FIGS. 8*b*, 8*c*, 8*e* and 8*g*). The three panels can be adjusted angularly and translationally to support various seating positions including kneeling (FIG. 8*e*, 8*f*), and various Yoga sitting and backward extension (FIG. 8*e*, 8*g*) and restorative poses. FIG. 8*g* illustrates a perspective view of a user's silhouette in a backward extension posture Viparita Dandasana with bent knees. In more advanced poses the user may straighten the legs and knees, while extending and maintaining the ankles on the floor.

Figure 8H:
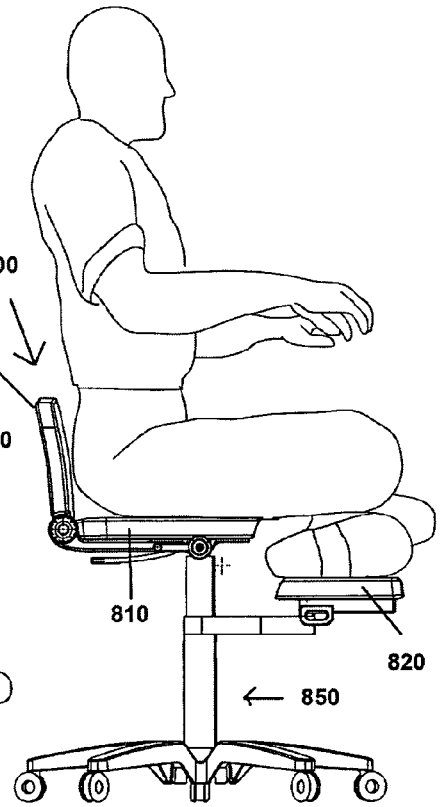

FIG. 8*h* illustrates a side view of a user's silhouette in a crossed leg Yogic sukasana sitting posture, with the frontal and shin support element in an appropriate position lower than the seat element.

Figure 8I:
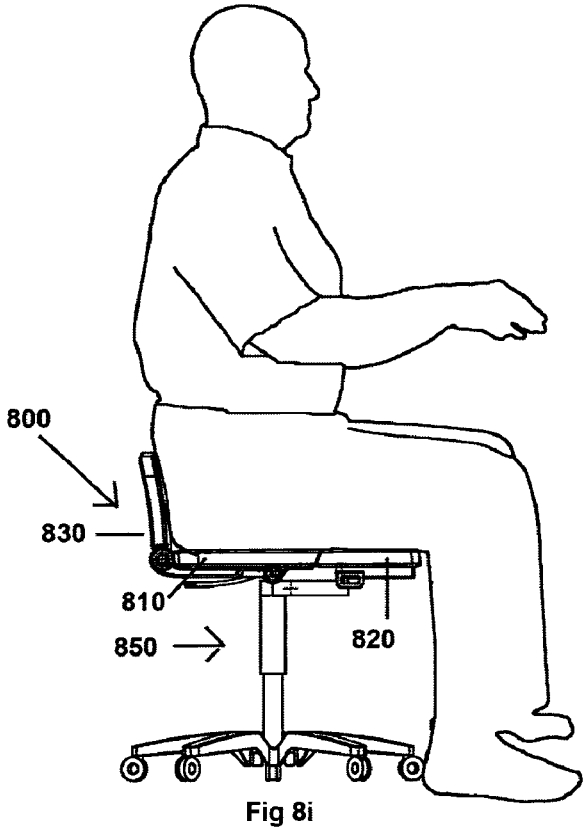
Figure 8J:
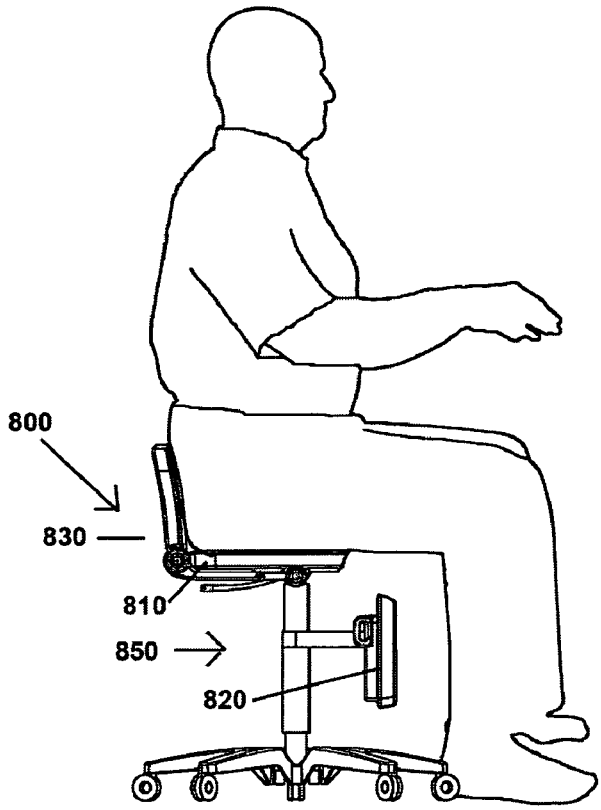

FIG. 8*i* illustrates a side view of a user's silhouette in a regular sitting position. Moreover, by folding the frontal and shin support element 820 completely downwards, the user may also sit upright in the respective Yogic sitting posture Maitriyasana (shown in FIG. 8*j*). The difference between Maitriyasana and regular sitting as depicted in FIG. 8*i* is that in regular sitting the sitting bones, buttocks and thighs are all placed and pressed onto the seat surface thereby making it more difficult for the user to extend further up through the lengthening of the lower spine. In Maitriyasana, only the sitting bones and buttocks are placed on the seat surface, hence enabling the user to further extend from the sitting bones upwards, while activating the thighs by rolling them inwards thereby increasing the upwards extension and further increasing the action of lower spine upwards extension by the sucking in of the sacrum into the pelvis.

Three elements of the current invention including (a) an adjustable support element, typically located frontally to the seat and at a typically lowered elevation lower to, or equal to that of the seat, (b) a respective highly versatile and adjustable backrest element with forward and backward reclining capabilities, and (c) adjustable armrest elements, which when used separately or together, facilitate the positioning of the person's body in a variety of poses.

The various poses are enabled by different positions of the frontal support, backrest and armrest elements. For example, in sitting poses, typically the seat element supports the sitting bones and pelvis, the frontal support element will support the feet, shins and legs, the armrest elements are positioned to support the elbows and arms or the outer thighs, while the backrest element will support the lower and upper back. Alternatively, in a specific reversed backward extension, for example, the frontal support element may support the upper back, shoulders, neck and head, the seat will support the sacrum and the back pelvis, while the backrest is positioned in order to best support the back of the thighs or shins, depending on the specific pose.

Another element of the invention provides for rapid and simple transitions between the different positions, as well as returning to the conventional functionality and utility of the chair. It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub combination.

Although the invention has been described in conjunction with specific embodiments thereof, it is evident that many alternatives, modifications and variations will be apparent to those skilled in the art.

All publications, patents and patent applications mentioned in this specification are herein incorporated in their entirety by reference into the specification.

The invention claimed:

1. A seating apparatus, comprising:

a frame element comprising at least a base member and a vertical support extending vertically therefrom;

a seat portion supported by the vertical support element, the seat portion having front and rear segments;

the front segment having (i) a first, regular seating position in which a top face thereof is level with a top face of the rear segment so that the top faces of both segments jointly define an essentially planar seating surface, and (ii) a second position in which the seat is configured to have a first seating surface defined by the rear segment and a second surface, essentially parallel to and at a level lower than said first surface, defined by said front segment and overhanging the frame element; and wherein the front segment is switched between the two positions in a pivotal manner about a pivot at a front end of the seat.

2. The seating apparatus according to claim 1, wherein in the first position the front segment rests on a base with its bottom face being in contact and facing a top face of the base, and upon a pivoting switch to the second position the initially bottom face of the front segment becomes the top face defining jointly with the top face of the base the second surface.

3. The seating apparatus according to claim 1, further comprising at least one back support element.

* * * * *